US010286528B2

(12) United States Patent
Hsieh

(10) Patent No.: US 10,286,528 B2
(45) Date of Patent: May 14, 2019

(54) IMPACT SPINNING HAND TOOL

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 227 days.

(21) Appl. No.: 15/368,662

(22) Filed: Dec. 4, 2016

(65) Prior Publication Data

US 2017/0157751 A1 Jun. 8, 2017

(30) Foreign Application Priority Data

Dec. 8, 2015 (TW) ..... 104141112 A

(51) Int. Cl.
*B25B 19/00* (2006.01)
*B25B 15/02* (2006.01)

(52) U.S. Cl.
CPC ..... *B25B 19/00* (2013.01); *B25B 15/02* (2013.01)

(58) Field of Classification Search
CPC ..... B25B 19/00; B25B 21/02; B25B 15/02; B25B 13/48; B25B 27/02
See application file for complete search history.

(56) References Cited

U.S. PATENT DOCUMENTS 3,153,434 A * 10/1964 Kiyoshi ..... B25B 15/06 279/102
3,602,072 A * 8/1971 Sensat ..... E21B 17/021 81/460
2016/0176026 A1* 6/2016 Wu ..... B25B 15/06 81/58.3

* cited by examiner

*Primary Examiner* — Robert J Scruggs
(74) *Attorney, Agent, or Firm* — CKC & Partners Co., LLC

(57) ABSTRACT

An impact spinning hand tool includes a hollow body, a first lever and a first elastic member. The hollow body includes a first position-limiting structure. The first lever includes a driving end exposed outside the hollow body, a spinning structure and a forcing end contained in the hollow body. The forcing end has a second position-limiting structure that is detachably limited by the first position-limiting structure. The first elastic member is pushed against the forcing end and the first position-limiting structure through two ends thereof. The first lever is located at a first position and presses the first elastic member to store an elastic restoring force when being connected with the hollow body. When the second position-limiting structure is released, the elastic restoring force drives the first lever to move to a second position so as to allow the spinning structure to perform an impact spinning action.

15 Claims, 7 Drawing Sheets

IMPACT SPINNING HAND TOOL

RELATED APPLICATIONS

This application claims priority to Taiwan Application Serial Number 104141112, filed Dec. 8, 2015, which is herein incorporated by reference.

BACKGROUND

Technical Field

The present disclosure relates to a hand tool. More particularly, the present disclosure relates to a hand tool with a general function and an impact spinning function.

Description of Related Art

A screw has been widely used inlocking parts and assembling machines. To date, the common living things, such as home electronics and vehicles, are all assembled by all different size of screws. The screws are connected to an object tightly by using a helical force, and they are easier to be assembled and detached so as to be used widely. Screwdriver is a useful hand tool using for turning the screws into or out of parts and machines. However, when the screw thread is over damaged, seriously rusted or expended by weather changes, it will cause the screw stuck in the parts. Thus, it is hard to release the screw by hand.

In order to solve the above problem, an impact spinning screwdriver is developed. Currently, the impact spinning screwdriver is a common hand tool and mainly composed by iron. In detail, one end of the impact spinning screwdriver is a forcing end that is made by a hard material and the other end of the impact spinning screwdriver is a driving end. In operation, the driving end of the impact spinning screwdriver is pushed against the screw, and a hammer is used to knock the forcing end of the impact spinning screwdriver. Using an impact force producing from knocking will impact the screw stocked in the parts and continually make it loosen in order to take it out.

A general screwdriver is utilized to complete the detachment of the screw after the screw starts to be loosened by the impact spinning screwdriver. Otherwise, the general screwdriver is utilized at first when screwing. Then, the impact spinning screwdriver is utilized to strengthen the screwing so that the screw will be tightly connected to the parts. However, the impact spinning screwdriver and the general screwdriver are used in turn during the screwing process, and it is in convenient for users.

Accordingly, a hand tool integrated with a general function and an impact spinning function has been developed for a while. However, the whole structure of such the integrated hand tool always lacks the stability.

SUMMARY

The present disclosure provides an impact spinning hand tool including a hollow body, a first lever and a first elastic member. The hollow body includes a first position-limiting structure, and the first lever includes a driving end, a spinning structure and a forcing end. The driving end is exposed outside the hollow body. The spinning structure and the forcing end are both contained in the hollow body, and the forcing end has a second position-limiting structure that is detachably limited by the first position-limiting structure. The first elastic member is disposed in the hollow body and pushed against the forcing end of the first lever and the first position-limiting structure of the hollow body through two ends thereof. When the first lever is connected with the hollow body, the first lever is located at a first position and presses the first elastic member to store an elastic restoring force. When the second position-limiting structure is separated from the first position-limiting structure, the elastic restoring force drives the first lever to move to a second position so as to allow the spinning structure to perform an impact spinning action.

The present disclosure further provides an impact spinning hand tool including a hollow body, a first lever, a button and a first elastic member. The hollow body includes a first position-limiting structure, and the first lever includes a driving end, a spinning structure and a forcing end. The driving end exposed outside the hollow body, and the spinning structure and the forcing end are both contained in the hollow body. The forcing end has a second position-limiting structure that is detachably limited by the first position-limiting structure. The button is disposed at the hollow body corresponding to the driving end and selectively pushed against the forcing end. The first elastic member is disposed in the hollow body and pushed against the forcing end of the first lever and the first position-limiting structure of the hollow body through two ends thereof. When the first lever is connected with the hollow body, the first lever is located at a first position and presses the first elastic member to store an elastic restoring force. When the button pushes the forcing end to allow the second position-limiting structure to be separated from the first position-limiting structure, the elastic restoring force drives the first lever to move to a second position so as to allow the spinning structure to perform an impact spinning action.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
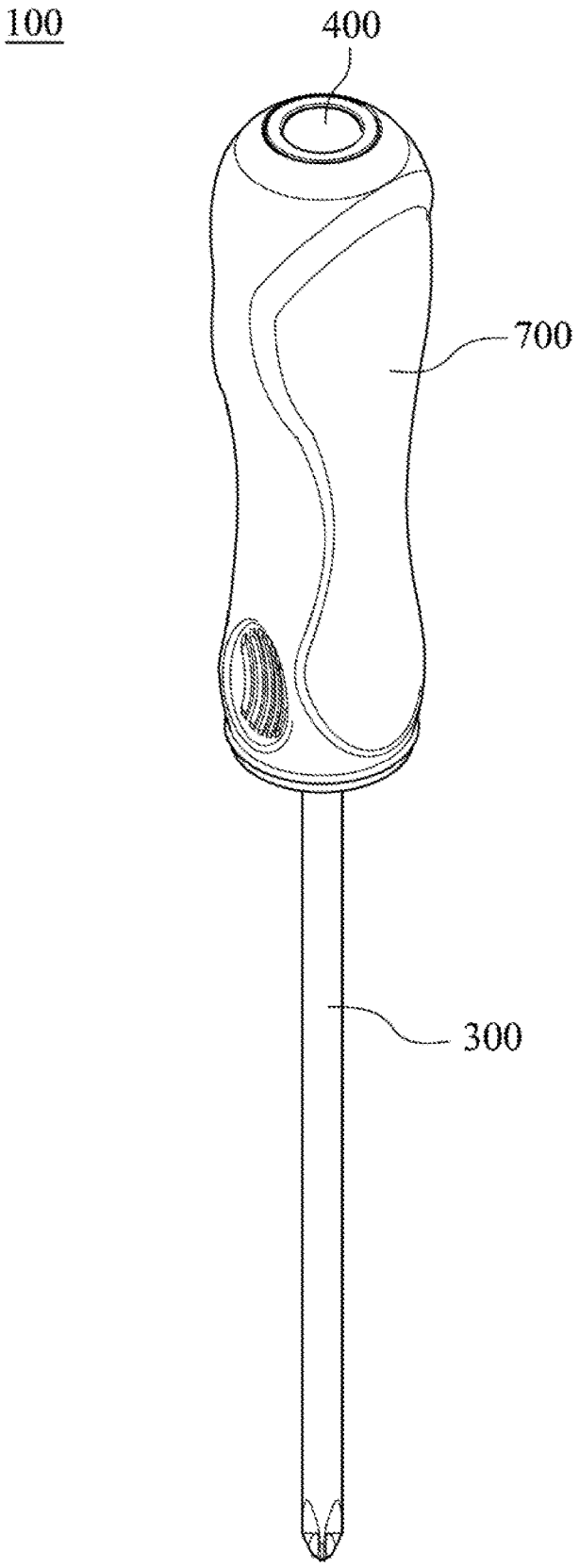
FIG. 1 is a schematic diagram showing an appearance of an impact spinning hand tool according to an embodiment of the present disclosure.
Figure 2A:
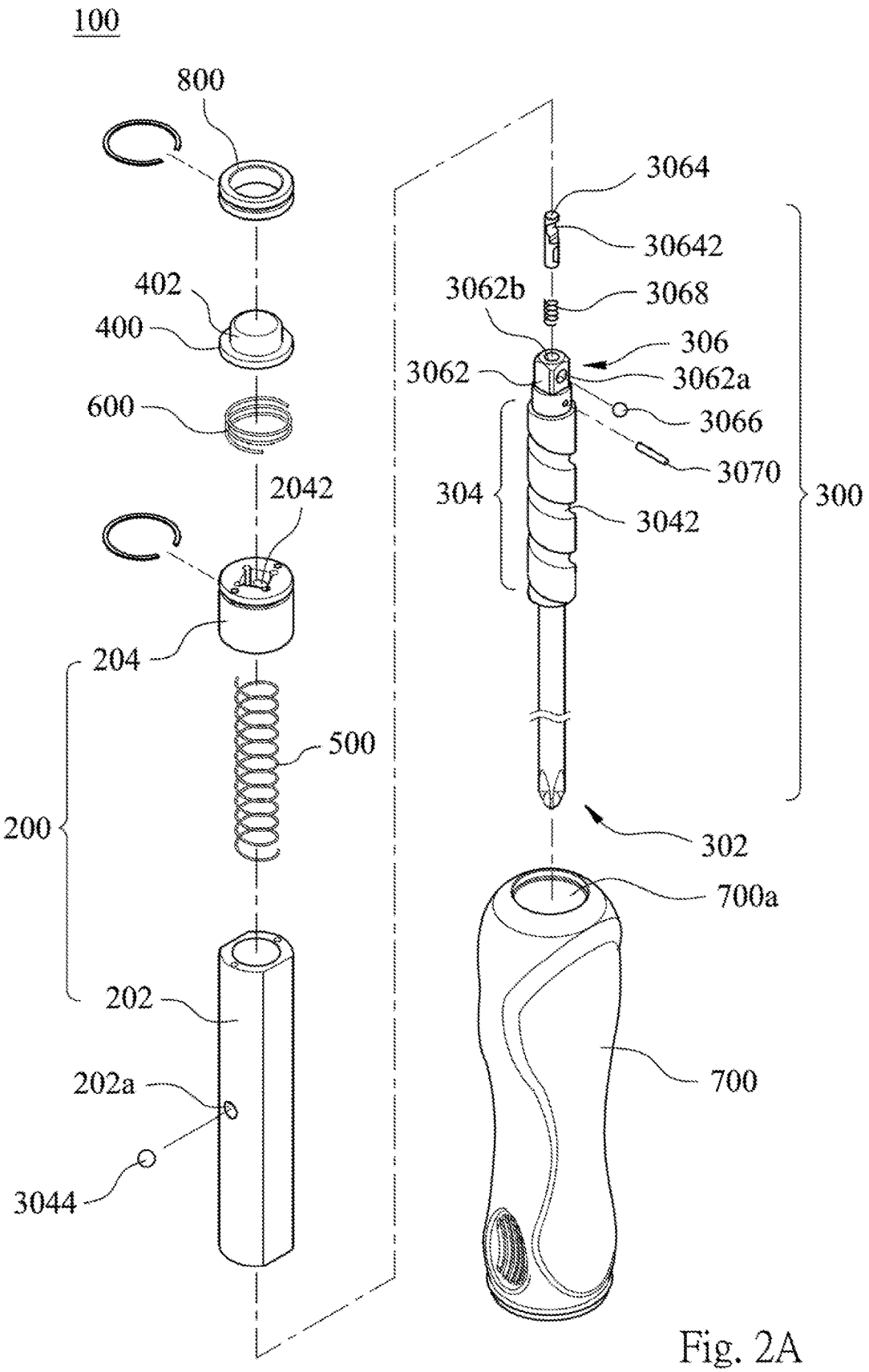
FIG. 2A is an exploded diagram showing the impact spinning hand tool according to the embodiment of the present disclosure.
Figure 2B:
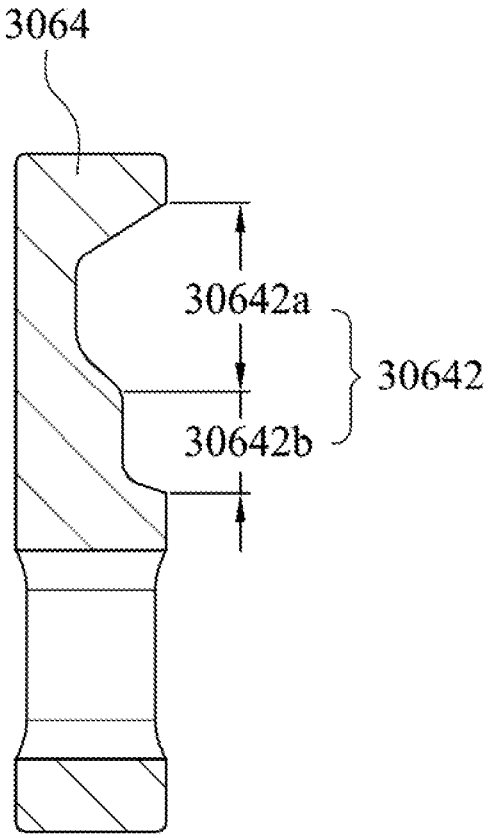
FIG. 2B is a schematic diagram showing a second lever of FIG. 2A.
Figure 3:
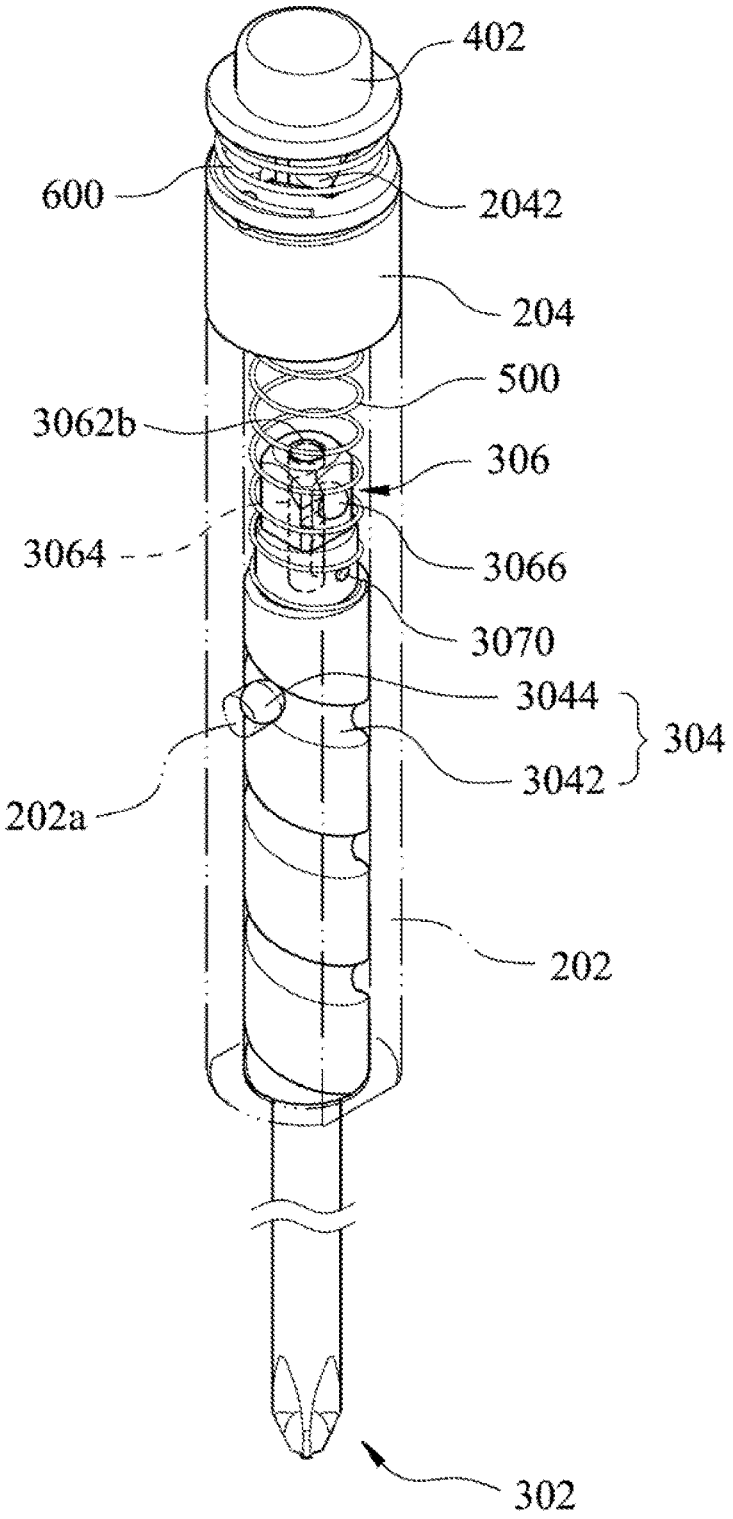
FIG. 3 is an assembling schematic diagram showing the impact spinning hand tool according to the embodiment of the present disclosure.
Figure 4A:
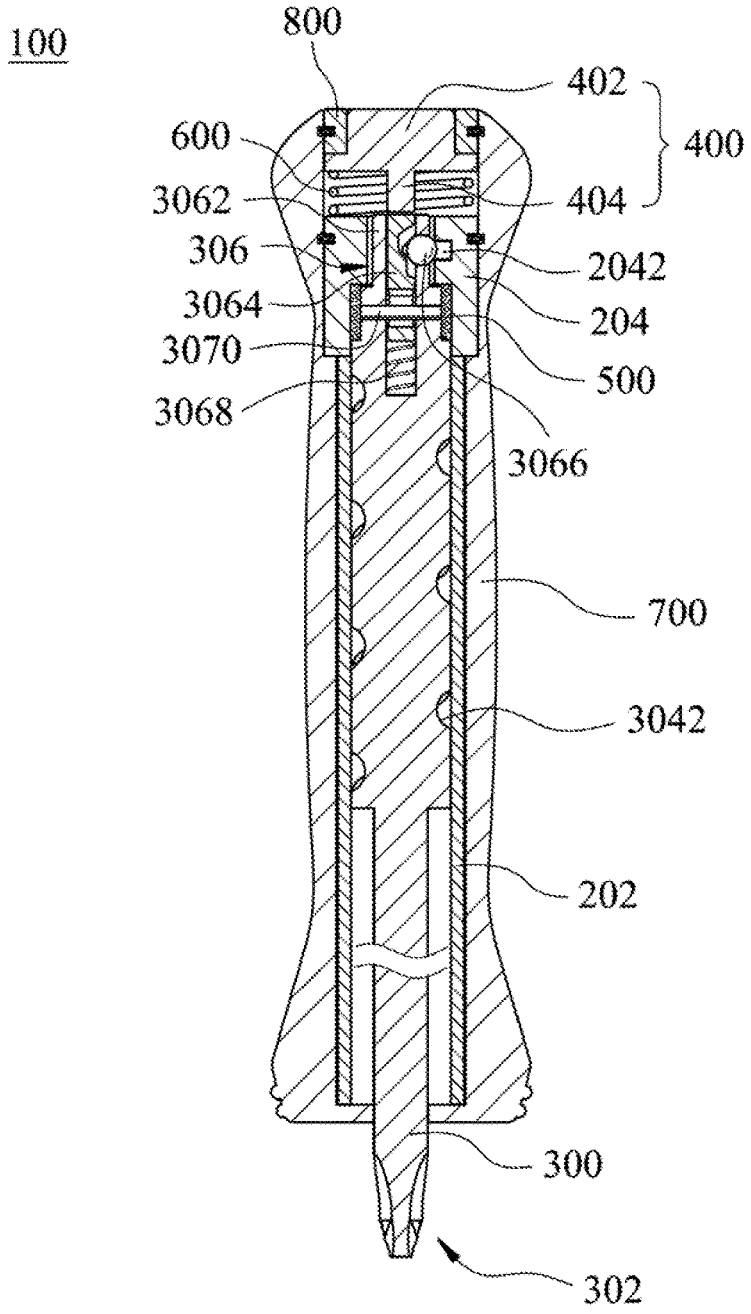
FIG. 4A is a cross-sectional schematic diagram showing the impact spinning hand tool in which a first lever is located at a first position according to the embodiment of the present disclosure.
Figure 4B:
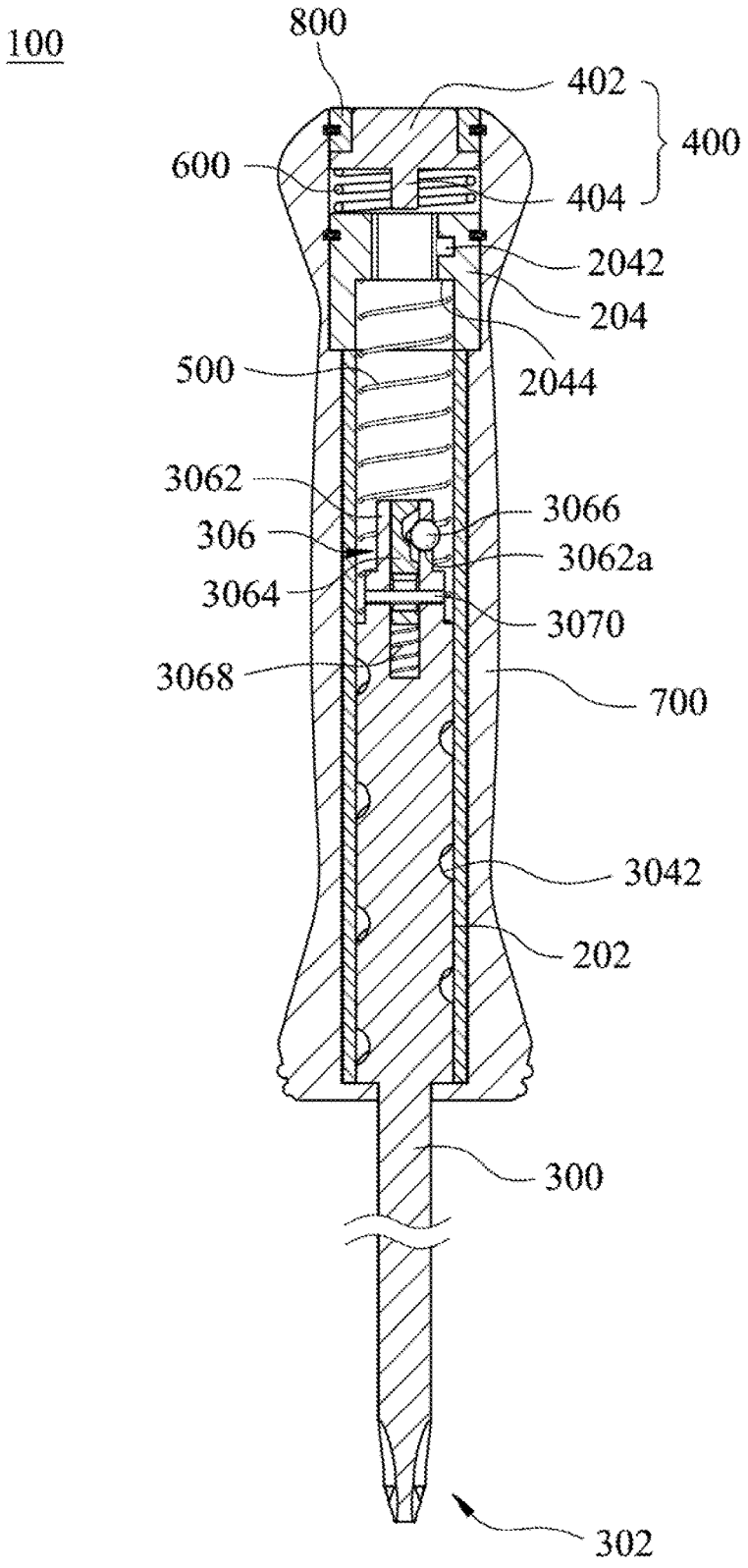
FIG. 4B is a cross-sectional schematic diagram s hoeing the impact spinning hand tool in which the first lever is located at a second position according to the embodiment of the present disclosure.
Figure 4C:
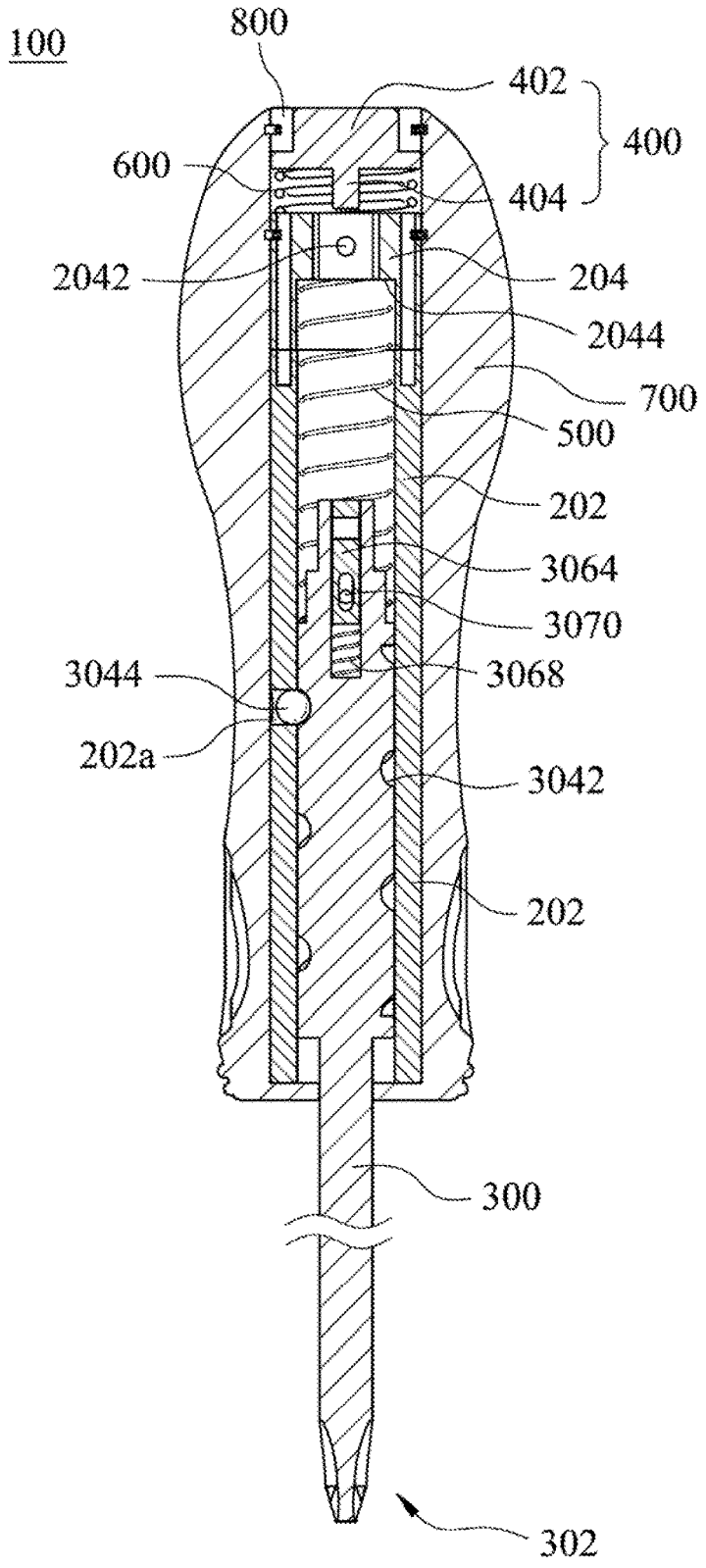
FIG. 4C is another cross-sectional schematic diagram showing the impact spinning hand tool in which the first lever is located at the second position according to the embodiment of the present disclosure.

Please refer from FIG. 1 to FIG. 4C, FIG. 1 is a schematic diagram showing an appearance of an impact spinning hand tool 100 according to an embodiment of the present disclosure, FIG. 2A is an exploded diagram showing the impact spinning hand tool 100 according to the embodiment of the present disclosure of FIG. 1, FIG. 2B is a schematic diagram showing a second lever 3064 of FIG. 2A, FIG. 3 is an assembling schematic diagram showing the impact spinning hand tool 100 according to the embodiment of the present disclosure of FIG. 1, FIG. 4A is a cross-sectional schematic diagram showing the impact spinning hand tool 100 in which a first lever 300 is located at a first position according to the embodiment of the present disclosure of FIG. 1, FIG. 4B is a cross-sectional schematic diagram showing the impact spinning hand tool 100 in which the first lever 300 is located at a second position according to the embodiment of the present disclosure of FIG. 1, and FIG. 4C is another cross-sectional schematic diagram showing the impact spinning hand tool 100 in which the first lever 300 is located at the second position according to the embodiment of the present disclosure of FIG. 1. As shown in the figures, the impact spinning hand tool 100 includes a hollow body 200, a first lever 300, a button 400 and a first elastic member 500.

For convenience of setting up, the hollow body 200 shown in FIG. 2A consists of first sleeve 202 and a second sleeve 204, in which the first sleeve 202 and the second sleeve 204 are communicated with each other. However, the hollow body 200 also can be a single sleeve, and will not be limited thereto.

As shown in FIG. 2A and FIG. 4A, the hollow body 200 includes a first position-limiting structure, and the first position-limiting structure is disposed in the second sleeve 204. More particularly, the first position-limiting structure is disposed on an inner wall of the second sleeve 204. Furthermore, the first position-limiting structure includes a position-limiting portion 2042 and a stop portion 2044. The position-limiting portion 2042 can be but not limited to a recess, a protrusion, a clamping member, an adhesive member and a buckle member. The stop portion 2044 not only can be a protrusion disposed on the inner wall of the second sleeve 204 but also can be formed by gradually decreasing an inner diameter of the second sleeve 204 along a direction away from the first sleeve 202.

In FIG. 2A, the first lever 300 includes a driving end 302, a spinning structure 304 and a forcing end 306. The driving end 302 may have a rod-like, a tip-like, a knife-like or other appearance on demand. However, the present disclosure is not limited thereto. The spinning structure 304 and the forcing end 306 are both contained in the hollow body 200. In particular, the spinning structure 304 and the forcing end 306 are contained in the first sleeve 202, and the driving end 302 is exposed outside the first sleeve 202. Moreover, the stop portion 2044 is located between the forcing end 306 of the first lever 300 and the position-limiting portion 2042 of the first position-limiting structure.

The forcing end 306 of the first lever 300 has a second position-limiting structure. In particular, the second position-limiting structure includes a receiving groove 3062, a second lever 3064, a steel ball 3066 and a second elastic member 3068. As shown in FIG. 2A, the receiving groove 3062 is located at the forcing end 306 of the first lever 300 and has a first through hole 3062*a*. The second lever 3064 is disposed in the receiving groove 3062 and has a concave portion 30642 corresponding to the first through hole 3062*a*. The steel ball 3066 is contained in the first through hole 3062*a* and contacted with the concave portion 30642. When the hollow body 200 is connected with the first lever 300, the steel ball 3066 is limited by the position-limiting portion 2042. The second elastic member 3068 is disposed in the receiving groove 3062 for allowing the second lever 3064 to move forward and backward alternately when the second position-limiting structure is separated from the first position-limiting structure.

In FIG. 2B, the concave portion 30642 of the second lever 3064 includes a first sub-portion 30642*a* and a second sub-portion 30642*b*. A depth of the first sub-portion 30642*a* in a minor axis of the second lever 3064 is larger than a depth of the second sub-portion 30642*b* in the minor axis of the second lever 3064. When the steel ball 3066 moves from the second sub-portion 30642*b* to the first sub-portion 30642*a*, it can be released from a limitation of the position-limiting portion 2042.

The second position-limiting structure further includes a plug 3070. The plug 3070 passes through the receiving groove 3062 and the second lever 3064. When the second lever 3064 moves forward and backward alternately as mentioned above and presses the second elastic member 3068, the plug 3070 brings the first lever 300 to move. The connections between the first lever 300, the second lever 3064, the steel ball 3066, the second elastic member 3068 and the plug 3070 will be illustrated in cooperated with FIG. 4A, FIG. 4B and FIG. 4C in the following, there is no further description herein.

Please refer back to FIG. 2A, the spinning structure 304 includes a guiding groove 3042 and a guiding member 3044. The guiding groove 3042 surrounds a surface of the first lever 300. The guiding member 3044 can be a steel ball, and the first sleeve 202 of the hollow body 200 has a second through hole 202*a* corresponding to the guiding member 3044 so as to allow the guiding member 3044 to be contained in the second through hole 202*a*. When the driving end 302 of the first lever 300 is pushed against an element to be operated and the forcing end 306 is impacted by an external force, the first lever 300 internally shrinks toward the first sleeve 202 of the hollow body 200 to allow the guiding member 3044 entering into the guiding groove 3042 and moving along the guiding groove 3042 so as to drive the first lever 300 to spin. It is noted that the guiding member 3044 also can be a protrusion disposed on the inner wall of the first sleeve 202 and move along the guiding groove 3042. In addition, the element to be operated can be but not limited to a screw member.

As shown in FIG. 2A, FIG. 3 and FIG. 4A, the first elastic member 500 is located in the hollow body 200 and pushed against the forcing end 306 of the first lever 300 and the stop portion 2044 of the first position-limiting structure, respectively, through two ends thereof. In particular, one end of the first elastic member 500 is sleeved out of the receiving groove 3062 of the forcing end 306 in the first sleeve 202, and the other end of the first elastic member 500 is pushed against the stop portion 2044 of the first position-limiting structure in the second sleeve 204 so as to be stopped by the stop portion 2044. Thus, the first elastic member 500 is not exposed out of the second sleeve 204.

The button 400 is disposed at the hollow body 200 corresponding to the driving end 302 and selectively pushed against the forcing end 306. In particular, the button 400 includes a pressing portion 402 and a pushing portion 404. The pushing portion 404 is protruded from the pressing portion 402 and extends into the second sleeve 204. Accordingly, the receiving groove 3062 of the second position-limiting structure of the forcing end 306 further has a third through hole 3062*b* corresponding to the pushing portion 404 of the button 400. The second lever 3064 is disposed in the receiving groove 3062 and exposed through the third through hole 3062*b*. In addition, opposed to the third through hole 3062*b*, the second elastic member 3068 is disposed between the second lever 3064 and the bottom of the receiving groove 3062. That is, an extending direction of the second elastic member 3068 overlaps with a major axis direction of the second lever 3064. When the hollow body 200 is connected to the first lever 300, the third through hole 3062*b* faces to the pushing portion 404 of the button 400. The button 400 selectively pushes the second lever 3064 by the pushing portion 404 through the third through hole 3062*b* and the second elastic member 3068 subsequently allows the second lever 3064 to move forward and backward alternately.

According to the abovementioned impact spinning hand tool 100, it further includes a third elastic member 600. The third elastic member 600 is sleeved on the pushing portion 404 of the button 400 and located between the pressing portion 402 and the second sleeve 204. When the hollow body 200 is connected to the first lever 300 and the button 400 selectively pushes the second lever 3064 by the pushing portion 404 through the third through hole 3062*b*, the third elastic member 600 is pressed.

As shown in FIG. 2A, FIG. 4A, FIG. 4B and FIG. 4C, the button 400 can be fastened on the hollow body 200 by a fastening member 800. However, the present disclosure is not limited thereto.

The impact spinning hand tool 100 further includes a handle 700 that is convenient for a user to handle. The handle 700 is also provided for covering the hollow body 200 and the button 400. In particular, the handle 700 includes at least one opening 700*a* for exposing the button 400. More particularly, a surface of the button 400 and a surface of the handle 700 are coplanar so that it prevents the button 400 from damages due to the applied external force.

In addition, it is noted that the button 400 and the corresponding elements as mentioned above can be omitted according to another embodiment of the present disclosure. For example, the impact spinning hand tool 100 can only include the hollow body 200, the first lever 300 and the first elastic member 500. The hollow body 200 includes the first position-limiting structure, and the forcing end 306 of the first lever 300 has the second position-limiting structure. In this embodiment, it is different that there are openings disposed at the hollow body 200 and the handle 700, respectively and correspondingly, for exposing the first position-limiting structure. When the hollow body 200 is connected to the first lever 300, the first lever 300 is located at the first position and the second position-limiting structure is limited by the first position-limiting structure. Now, the second position-limiting structure can be pushed directly through the openings of the hollow body 200 and the handle 700 and released from the limitation of the first position-limiting structure. Then, the elastic restoring force provided by the first elastic member 500 drives the first lever 300 to move to the second position. The details of the hollow body 200, the first position-limiting structure and the second position-limiting structure have been illustrated, and there is no further description herein.

An operation method of the impact spinning hand tool 100 according to the present disclosure will be further described in cooperated with FIG. 4A, FIG. 4B and FIG. 4C in the following.

First, the second position-limiting structure disposed at the forcing end 306 of the first lever 300 is detachably limited by the first position-limiting structure disposed in the second sleeve 204 of the hollow body 200. As shown in FIG. 4A, the position-limiting portion 2042 of the position-limiting structure is a recess. The steel ball 3066 of the second position-limiting structure is located between the second sub-portion 30642*b* of the concave portion 30642 and the first through hole 3062*a*. Thus, the steel ball 3066 is partially exposed through the first through hole 3062*a* and embedded into the position-limiting portion 3042 of the first position-limiting structure so as to connect the hollow body 200 to the first lever 300. The first lever 300 is located at the first position now and presses the first elastic member 500 for storing the elastic restoring force. Moreover, the impact spinning hand tool 100 is a hand tool capable of performing a general function now.

The pressing portion 402 of the button 400 can be pressed to push the second lever 3064 of the forcing end 306 by the pushing portion 404 thus to allow the steel ball 3066 moving from the second sub-portion 30642*b* of the concave portion 30642 to the first sub-portion 30642*a*, which is deeper than the second sub-portion 30642*b*. Accordingly, the steel ball 3066 is released from the limitation of the position-limiting portion 2042 of the first position-limiting structure. Because the plug 3070 passes through the receiving groove 3062 and the second lever 3064, the second lever 3064 will bring the plug 3070 to move along a pressed direction of the button 400 when the pushing portion 404 of the button 400 pushes the second lever 3064. Thus, the first lever 300 is driven to move toward the second position for helping the second position-limiting structure to be separated from the first position-limiting structure. Then, the elastic restoring force of the first elastic member 500 drives the first lever 300 to move to the second position as shown in FIG. 4B and FIG. 4C. Moreover, the guiding member 3044 is located in the guiding groove 3042 as shown in FIG. 4C so that the guiding member 3044 will move along the guiding groove 3042 to driving the first lever 300 to perform the impact spinning action when the external force applies on the forcing end 306.

An additional force can be applied on the driving end 302 of the first lever 300 for turning the impact spinning function back to the general function of the impact spinning hand tool 100, and thus the first lever 300 will internally shrinks toward the hollow body 200. At this time, the forcing end 306 of the first lever 300 will enter the second sleeve 204 from the first sleeve 202 and is limited by the position-limiting portion 2042 of the second sleeve 204. In the meanwhile, the first elastic member 500 is pressed and stopped by the stop portion 2044 of the second sleeve 204. That is, the first lever 300 returns to the first position as shown in FIG. 4A.

To sum up, the impact spinning hand tool is a hand tool having two functions, that is, the general function and the impact spinning function. For the convenience of the user, the two functions of the impact spinning hand tool can be switched quickly by the button. In addition, the structure, which is set up for switching the two functions, of the impact spinning hand tool according to the present disclosure is disposed, at the forcing end. When the hand tool is utilized under the general function, it can be maintained by using the abovementioned design and will not return to the impact spinning function resulted from the contact of the element to be operated. Thus, the stability of the impact spinning hand tool provided in the present disclosure is increased.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. An impact spinning hand tool, comprising:

a hollow body comprising a first position-limiting structure;

a first lever comprising:

a driving end exposed outside the hollow body;

a spinning structure contained in the hollow body;

a forcing end contained in the hollow body and having a second position-limiting structure that is detachably limited by the first position-limiting structure; and a first elastic member disposed in the hollow body and pushed against the forcing end of the first lever and the first position-limiting structure of the hollow body through two ends thereof;

wherein the first lever is located at a first position when the first lever is connected with the hollow body and presses the first elastic member to store an elastic restoring force;

wherein the elastic restoring force drives the first lever to move to a second position when the second position-limiting structure is separated from the first position-limiting structure so as to allow the spinning structure to perform an impact spinning action.

2. The impact spinning hand tool of claim 1, wherein the first position-limiting structure comprises a position-limiting portion disposed in the hollow body and the second position-limiting structure comprises:

a receiving groove located at the forcing end of the first lever and having a first through hole;

a second lever disposed in the receiving groove and having a concave portion corresponding to the first through hole;

a steel ball contained in the first through hole and contacted with the concave portion, wherein the steel ball is limited by the position-limiting portion when the hollow body is connected with the first lever; and a second elastic member disposed in the receiving groove for allowing the second lever to move forward and backward alternately when the second position-limiting structure is separated from the first position-limiting structure.

3. The impact spinning hand tool of claim 2, wherein the first position-limiting structure further comprises:

a stop portion disposed in the hollow body and located between the forcing end of the first lever and the position-limiting portion so that the two ends of the first elastic member are pushed against the forcing end and the stop portion, respectively.

4. The impact spinning hand tool of claim 2, wherein the concave portion of the second lever comprises:

a first sub-portion; and a second sub-portion having a depth smaller than a depth of the first sub-portion;

wherein the steel ball moves from the second sub-portion to the first sub-portion so as to be released from a limitation of the position-limiting portion.

5. The impact spinning hand tool of claim 2, wherein the second position-limiting structure further comprises:

a plug passing through the receiving groove and the second lever, wherein the plug brings the first lever to move toward the second position when the second lever moves forward and backward alternately and presses the second elastic member.

6. The impact spinning hand tool of claim 1, wherein the hollow body comprises a second through hole and the spinning structure comprises:

a guiding groove surrounding a surface of the first lever; and a guiding member contained in the second through hole of the hollow body;

wherein when the driving end of the first lever is pushed against an element to be operated and impacted by an external force, the first lever internally shrinks toward the hollow body to allow the guiding member entering into the guiding groove and moving along the guiding groove so as to drive the first lever to spin.

7. The impact spinning hand tool of claim 1, further comprising:

a handle covering the hollow body.

8. An impact spinning hand tool, comprising:

a hollow body comprising a first position-limiting structure;

a first lever comprising:

a driving end exposed outside the hollow body;

a spinning structure contained in the hollow body;

a forcing end contained in the hollow body and having a second position-limiting structure that is detachably limited by the first position-limiting structure;

a button disposed at the hollow body corresponding to the first lever, wherein the button is selectively pushed against the forcing end; and a first elastic member disposed in the hollow body and pushed against the forcing end of the first lever and the first position-limiting structure of the hollow body through two ends thereof;

wherein the first lever is located at a first position when the first lever is connected with the hollow body and presses the first elastic member to store an elastic restoring force;

wherein the elastic restoring force drives the first lever to move to a second position so as to allow the spinning structure to perform an impact spinning action when the button pushes the forcing end to allow the second position-limiting structure to be separated from the first position-limiting structure.

9. The impact spinning hand tool of claim 8, wherein the hollow body comprises:

a first sleeve containing the forcing end and the spinning structure;

a second sleeve communicated with the first sleeve and located between the first sleeve and the button;

wherein the first position-limiting structure comprises:

a position-limiting portion disposed on an inner wall of the second sleeve; and a stop portion disposed on the inner wall of the second sleeve and located between the forcing end of the first lever and the position-limiting portion so that the two ends of the first elastic member are pushed against the forcing end and the stop portion, respectively.

10. The impact spinning hand tool of claim 9, wherein the second position-limiting structure comprises:

a receiving groove located at the forcing end of the first lever, wherein the receiving groove has a first through hole in a minor axis direction of the first lever and a third through hole in a major axis direction of the first lever;

a second lever disposed in the receiving groove and exposed through the third through hole, wherein the second lever has a concave portion corresponding to the first through hole;

a steel ball contained in the first through hole and contacted with the concave portion, wherein the steel ball is limited by the position-limiting portion when the hollow body is connected with the first lever; and a second elastic member disposed corresponding to the third through hole and located between the second lever and a bottom of the receiving groove;

wherein the third through hole faces to the button when the hollow body is connected to the first lever to allow the first lever to be located at the first position;

wherein the second elastic member allows the second lever to move forward and backward alternately when the button pushes the second lever through the third through hole to separate the second position-limiting structure from the first position-limiting structure.

11. The impact spinning hand tool of claim 10, wherein the concave portion of the second lever comprises:

a first sub-portion; and a second sub-portion having a depth smaller than a depth of the first sub-portion;

wherein the button selectively pushes the second lever through the third through hole to allow the steel ball moving from the second sub-portion to the first sub-portion so as to be released from a limitation of the position-limiting portion when the hollow body is connected to the first lever to allow the first lever to be located at the first position.

12. The impact spinning hand tool of claim 10, wherein the button further comprises:

a pressing portion; and a pushing portion protruded from the pressing portion and extended into the second sleeve so as to selectively push the second lever through the third through hole.

13. The impact spinning hand tool of claim 12, further comprising:

a third elastic member sleeved on the pushing portion and located between the pressing portion and the second sleeve, wherein the button selectively pushes the second lever by the pushing portion through the third through hole so as to press the third elastic member when the hollow body is connected to the first lever to allow the first lever to be located at the first position.

14. The impact spinning hand tool of claim 8, further comprising:

a handle covering the hollow body and the button.

15. The impact spinning hand tool of claim 14, wherein the handle comprises at least one opening for exposing the button, and a surface of the button and a surface of the handle are coplanar.

* * * * *